United States Patent [19]

Griffin, Jr. et al.

[11] Patent Number: 5,046,974

[45] Date of Patent: Sep. 10, 1991

[54] ANCILLARY FILLER FOR STEERABLE OUTBOARD MOTOR

[76] Inventors: William J. Griffin, Jr.; William J. Griffin, III, both of 7161 Hwy. 95 South, Sandpoint, Id. 83864

[21] Appl. No.: 551,630

[22] Filed: Jul. 11, 1990

[51] Int. Cl.[5] ..... B63H 25/00

[52] U.S. Cl. ..... 440/63; 440/900

[58] Field of Search ..... 114/144 R, 162; 74/480 B; 440/53, 63, 900; 403/90

[56] References Cited

U.S. PATENT DOCUMENTS

| | | | |
|---|---|---|---|
| 511,479 | 12/1893 | Westbrook | 403/90 |
| 1,202,698 | 10/1916 | Ford | 403/90 |
| 2,309,159 | 1/1943 | Binger | 440/63 |
| 2,365,490 | 12/1944 | Pieron | 440/63 |
| 2,543,553 | 2/1951 | McAllister | 440/63 |
| 2,747,425 | 5/1956 | Ohlau | 114/162 |
| 3,174,357 | 3/1965 | Conklin . | |
| 3,374,849 | 9/1966 | Hanson . | |
| 3,456,525 | 7/1969 | Oldham . | |
| 3,955,438 | 3/1976 | Zakrzewski . | |
| 4,228,756 | 10/1980 | Storer | 114/162 |

*Primary Examiner*—Jesus D. Sotelo
*Assistant Examiner*—Stephen P. Avila
*Attorney, Agent, or Firm*—Keith S. Bergman

[57] ABSTRACT

An ancillary tiller provides a first shorter arm releasably interconnectable by mounting structure at its first end to an outboard motor and movably interconnecting by articulating linkage at its second end a second longer elongate arm. The motor mounting structure is adapted for selective interconnection to a motor shaft, tiller or guide grip. The articulating linkage interconnecting the first and second arm is of a combined axle and ball and socket type that allows universal positioning of the second arm relative the first arm and provides locking mechanism to releasably maintain such positioning. The second arm comprises two slidably related elongate elements having locking mechanism communicating therebetween to releasably maintain a selected length. The ancillary tiller is particularly adapted for steerage of small fishing boats powered by steering outboard motors.

3 Claims, 4 Drawing Sheets

ANCILLARY FILLER FOR STEERABLE OUTBOARD MOTOR

II. BACKGROUND OF INVENTION

IIA. Related Applications

There are no applications related hereto heretofore filed by these inventors in this or any foreign country.

IIB. Field of Invention

This invention relates to an ancillary tiller for boats powered by steerable outboard motors, and more particularly to such an ancillary tiller that allows selectively adjustable positioning relative to the motor.

IIC. Background and Description of Prior Art

In the use of small boats powered and steered by outboard motors, it is often desirable in general, and especially in the case of fishing activities, for a user to have means of steering the boat from various positions at a distance from the motor. This need has heretofore been recognized and various methods devised to fulfill it. The instant invention provides a new and novel device of this class.

One type of device that has become popular to allowing outboard motors steerage from remote positions has been a typical steering wheel structure that commonly has been positioned in the fore part of a boat at a distance from a rearwardly mounted motor. This class of device is readily distinguishable from an ancillary tiller in that it generally must be installed on and supported by the boat itself rather than merely by the outboard motor, and additionally the steering function may be carried out only from a position in the immediate vicinity of a steering wheel rather than from other variable positions within the boat.

Ancillary tillers or extensions as such have heretofore become known, but in general have provided structures that either are not movable relative to the motor that they control or else if movable, have been movable in one or possibly two perpendicular planes, but not in three mutually perpendicular planes. Such known devices also have often been of a complex and costly structure because they have combined features other than only tillage, especially such to regulate throttle controls on various outboard motors that have a rotary type throttle control associated with a tiller handle.

In contradistinction to this prior art, our invention seeks to provide an ancillary tiller that is used only for that purpose to allow simple and economic manufacture. It provides a compound structure, having a particular universal joint between two rigid arms, that allows universal positioning of the extension within the area limited by its length. The particular universal joint used in the device is of combined ball and socket and axle type that allows universality of motion, but yet provides a structure of substantial strength which may be easily and inexpensively manufactured from plastic by relatively simple molding processes.

Our invention resides not in any one of these features individually, but rather in the synergistic combination of all of the structures of our device that give rise to the functions necessarily flowing therefrom, as herein specified and claimed.

III. SUMMARY OF INVENTION

Our invention generally provides a compound ancillary tiller for manipulation of steerable outboard motors from a point within a boat distant from the motor. The extension provides a first shorter, rigid arm having mounting structure at a first end to releasably interconnect with an outboard motor and a universal joint at its second outer end releasably interconnecting a second longer arm of compound nature. The second arm provides two slidably related portions that may be adjustably positioned relative to each other to selectively determine length of the second arm. The universal joint combines features of both ball and socket and axle-type joints to allow motion relative of the arms in mutually perpendicular planes.

In providing such a ancillary tiller, it is:

A principal object to provide a compound ancillary tiller formed of mechanically interconnected rigid elements, the outer extension of which is universally positionable in an area spacedly adjacent an interconnected outboard motor to allow motor steerage from that area.

A further object is to provide such an ancillary tiller that allows motion of the outer end portion of the extension in three mutually perpendicular planes relative to the motor being serviced.

A still further object is to provide a particular universal joint for such a ancillary tiller that combines features of both a ball and socket and an axle type universal joints to provide a linkage of durability and strength that may be formed from plastic materials by molding for economic manufacture without sacrificing utility.

Other and further objects of our invention will appear from the following specification and accompanying drawings which form a part hereof. In carrying out the objects of our invention, however, it is to be understood that its features are susceptible to change of design and structural arrangement, with only one preferred and practical embodiment being illustrate in the accompanying drawings as is required.

IV. BRIEF DESCRIPTION OF DRAWINGS

In the accompanying drawings which form a part hereof and wherein like numbers of reference refer to similar parts throughout:

V. DESCRIPTION OF THE PREFERRED EMBODIMENT

Our invention generally comprises motor mounting structure 10 which releasably interconnects first arm 11 with articulating linkage 12 which in turn interconnects second compound arm 13.

Figure 1:
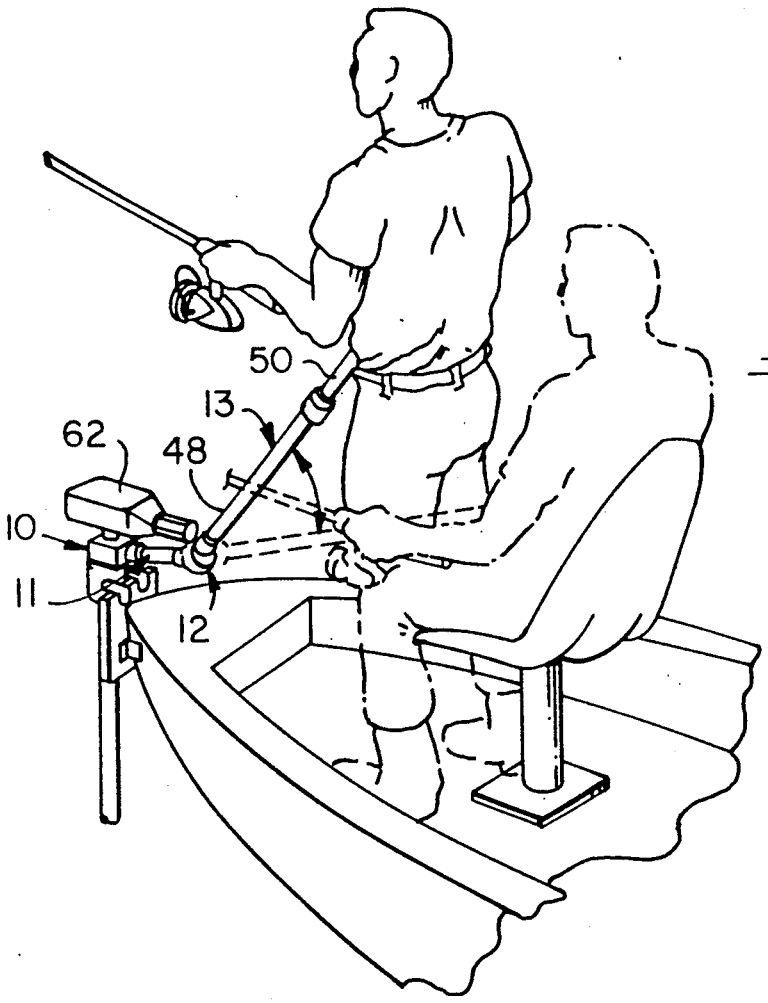
FIG. 1 is a partially cut-away isometric view of our ancillary tiller in use by a fisherman, with an alternate position shown in dashed outline.
Figure 2:
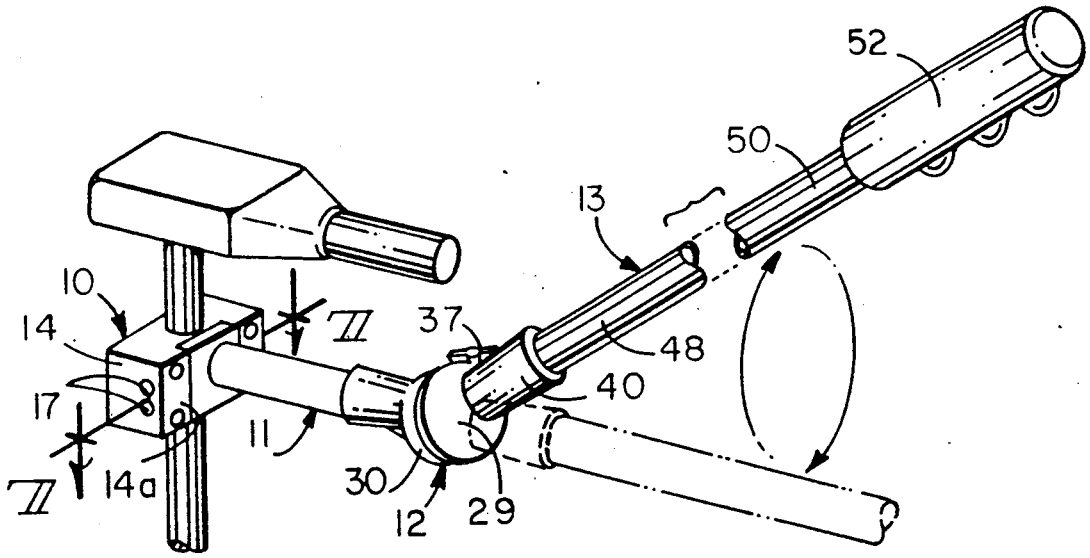
FIG. 2 is an isometric view of our ancillary tiller, in operative position on the shaft of a somewhat idealized steerable outboard motor, to show its various parts, their configuration and relationship.
Figure 3:
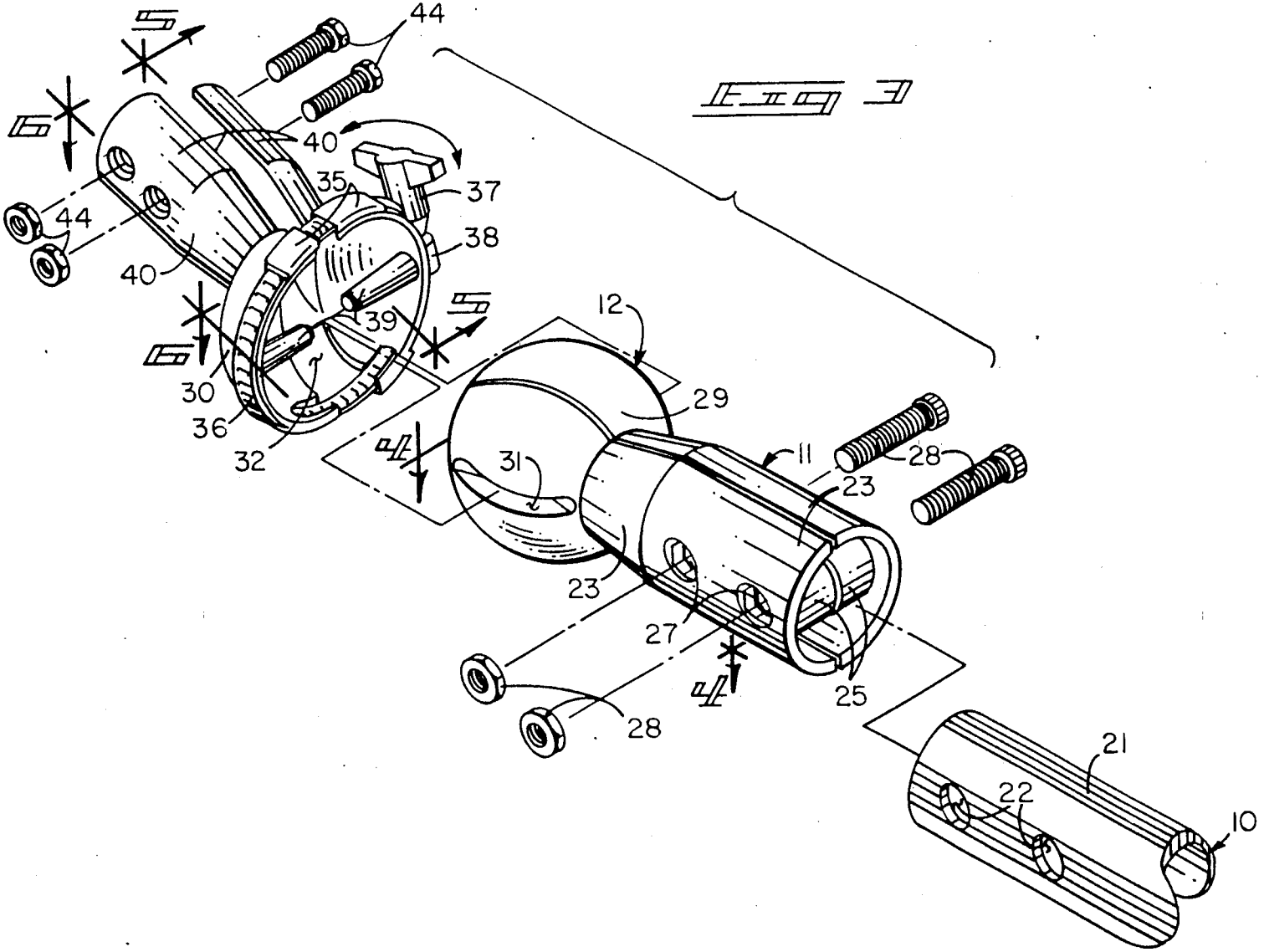
FIG. 3 is an expanded isometric view of the articulating linkage connecting the arms of our ancillary tiller showing details of its elements and their relationship.
Figure 4:
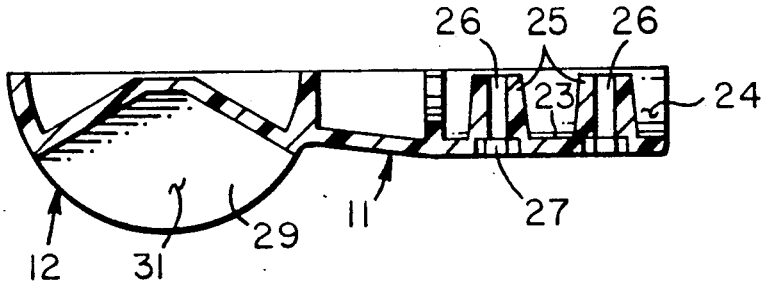
FIG. 4 is a cross-sectional view through one-half the ball portion of the linkage of FIG. 3, taken on the line 4—4 thereon in the direction indicated by the arrows.
Figure 5:
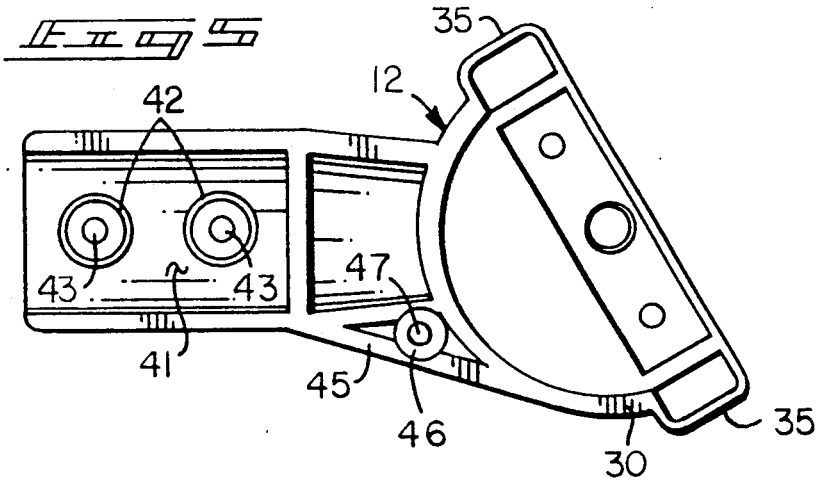
FIG. 5 is a vertical surface view of half the socket portion of the linkage of FIG. 3, taken such as on the line 5—5 thereon in the direction indicated by the arrows.
Figure 6:
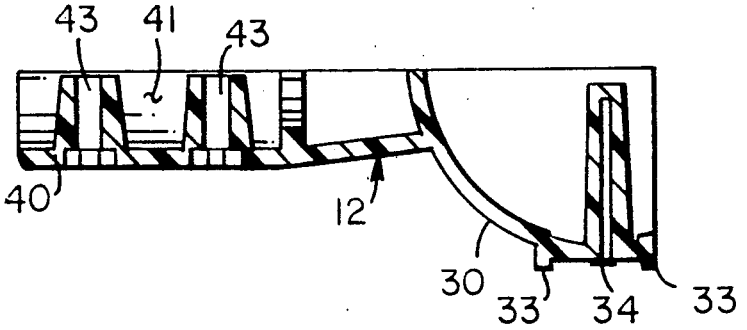
FIG. 6 is a horizontal cross-sectional view through one-half of the socket linkage illustrated in FIG. 3, taken on the line 6—6 thereon in the direction indicated by the arrows.
Figure 7:
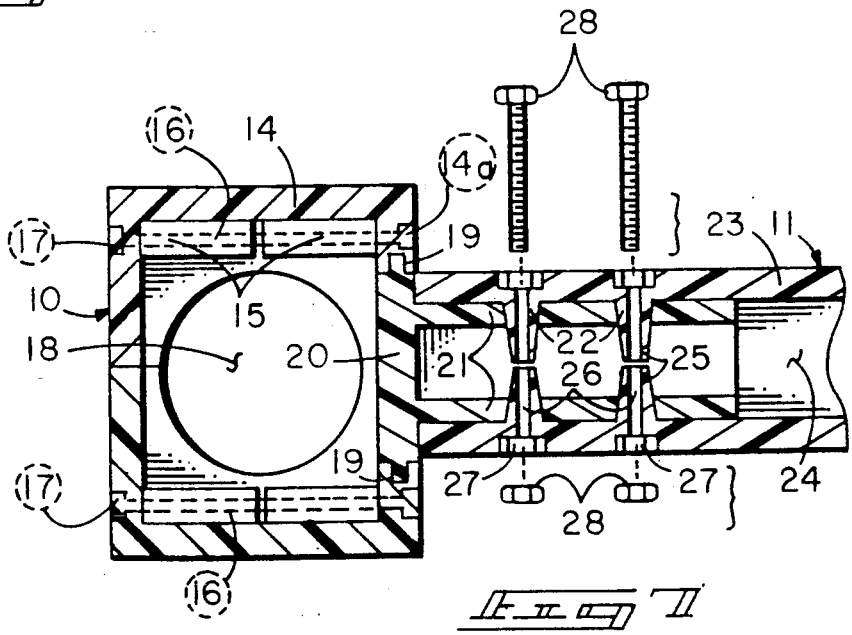
FIG. 7 is a horizontal cross-sectional view through the motor mounting structure of FIG. 2, taken on the line 7—7 thereon in the direction indicated by the arrows.

Motor mounting structure 10 is seen in gross in FIG. 2 and in sectional detail in FIG. 7. The structure provides peripherally defined box-like casement 14 formed by two similar halves, each having plural inwardly projecting pillar structures 15 extending into spaced adjacency and defining medial bolt channels 16 which allow releasable interconnection of the two casement halves by bolt-nut combinations 17 extending through the channels in the opposed pillar structures. The medial portion of the casement defines channel 18 to encompass and frictionally engage some portion of an outboard motor structure to which the ancillary tiller is to be connected, in the instance illustrated the vertical shaft of a motor. The channel 18 is peripherally defined by a plurality of spaced ribs, some or all of which provide channel defining surfaces of reasonably high frictional characteristics to positionally maintain the motor mounting structure on a motor without relative motion between that structure and the motor once established. It should be noted that a channel 18 may be adapted for mounting on other portions of the motor than its vertical shaft, such as a cylindrical steering handle or a handle type guide grip common on modern day outboard motors.

Forward wall 14*a* of the casement 14 defines slot 19 to slidably receive and positionally maintain fastening plate 20 carrying outwardly extending stub mounting shaft 21 to mount first arm 11. Stub mounting shaft 21 is a cylindrical element defining two sets of diametrically opposed pairs of mounting pillar holes 22 to aid fastening of the first arm thereto.

The only requirement of the motor mounting structure is to provide means for releasably positioning the mounting stub shaft 21 on some portion of an outboard motor to be serviced by the ancillary tiller, so that the mounting stub may provide means for fastening the arms of the ancillary tiller thereto. Other structures than that disclosed which serve the same purpose are within the scope of our invention.

First arm 11 provides elongate cylindrical shaft 23 defining medial channel 24 to conformably receive stub mounting shaft 21 of the motor mounting structure. The shaft 23 is formed by two similar diametrical halves, each defining paired spaced fastening pillars 25 extending inwardly in channel 24 to a position of spaced adjacency in the medial portion of that channel. Each fastening pillar defines medial bolt hole 26, with countersunk portions 27 at each outer end, to receive nut-bolt combinations 28 in a counter-sunk fastening relationship. The fastening pillars 25 are so configured and arrayed as to interfit within fastening pillar holes 22 defined in motor mounting structure 10 to provide means for releasably interconnecting that mounting structure with the first arm in a strong, rigid and durable fashion. The axial length of shaft 23 is not critical, but preferably is in the range of three to six inches. Commonly for ease of manufacture, though not necessarily, the first arm structure will be formed as an integral part of the ball structure of articulating linkage 12 and various devices or structures to aid alignment, such as interfitting protuberances and notches, may be defined by the interconnecting surfaces of the two parts of the first arm to aid their positioning relative to each other during assemblage, according to principles well known in the plastic molding arts.

Articulating linkage 12 is shown in gross in FIG. 2 and in detail in FIGS. 3–6 where it is seen to provide spherical ball 29 movably carried within socket 30. Ball 29 provides an external spherical surface defining paired diametrically opposed axle slots 31 extending radially inwardly to a spaced distance from the center of the ball. The axel slots are oriented in diametrical opposition parallel to each other and preferably parallel to the fastening pillars 25 of first arm 11. The slots have width sufficient to accommodate motion of socket axles carried therein and extend through a central angle of about ninety degrees. The slots define a radially innermost medial circular portion 31*a* to pivotally receive the inner end portion of a socket axle.

Ball 29 is structurally supported on first arm 11. In the instance illustrated, the two elements are formed as a unitary structure and with this method of formation, the ball is then necessarily formed by two similar interconnected halves because of the requirement that the first arm be so formed. It has been found that this structure may conveniently be formed from harder and more dense polymeric or resinous plastic material configured by known molding processes and if so formed, the structure preferably is of a peripherally defined type as illustrated. It is possible that the ball may be a solid element and if so formed may be mechanically joined to the first arm by known mechanical methods, especially such as threaded engagement, but the molding process of plastic material is preferred for ease and economy of manufacture.

Socket 30 is a generally hemispherical element providing a shell structure defining chamber 32 which comprises slightly more than a diametrical half of a sphere substantially the same size as the external surface of ball 29 so as to receive that ball in a slidable fit and positionally maintain it after initial placement. Preferably chamber 32 defines a central spherical angle of approximately one hundred ninety degrees to fulfill this purpose. The equatorial portion of socket 30 immediately inwardly of its periphery provides spaced, normally extending ridges 30 defining annular fastening channel 34 therebetween to receive and positionally maintain the band of a fastening element. At spaced positions about this channel closed loops are defined by bridging elements 35 to aid the positional maintenance of a fastening band within channel 34.

An adjustable fastening band of what is commonly known in modern day commerce as a "hose clamp" is carried in fastening channel 34. This clamp provides elongate, somewhat resilient band-like body 36 defining plural spaced laterally extending slots which are engaged by the threads of fastening screw 37 carried by fastening structure 38 interconnected at one end of the band-like body. Body 36 is of sufficient length that, where positioned in channel 34, its ends overlap with its slots engaged with screw 37 so that the band size may be adjusted by turning fastening screws 37. This type of fastening device is well known in the mechanical fastening arts, is not a part of our invention as such, and is therefore not illustrated or described in detail.

The inner surface of socket 30 that defines chamber 32 structurally carries two diametrically opposed fastening axles 39 that extend radially inwardly in chamber 30 and toward each other to a spaced distance from the center of chamber 32. The fastening axles are so arrayed and configured as to be movably received within axle slots 31 defined in ball 29, with inner end portions 39*a* pivotally carried in round inner portions 31*a* of the associated slot.

Socket 30 structurally interconnects tubular fastening sleeve 40 which interconnects second arm 13. The tubular fastening sleeve defines internal cylindrical channel 41 to receive the inner end portion of the second arm. The sleeve 40, on its inner surface defining channel 41, provides two spaced sets of paired opposed fastening pillars 42 that extend radially inwardly into spaced adjacency to aid in releasably interconnecting the second arm within the sleeve. The fastening pillars each define medial channels having enlarged outer end portions 43 to receive nut-bolt combinations 44 therebetween in an inset fastening fashion.

Tubular fastening sleeve 40 must be formed with two halves to provide and operative connecting system as described, and the sleeve must be structurally interconnected to socket 30. This structural interconnection may be accomplished by mechanical joinder, again especially such as created by a screw-type interconnection, but it is preferred that the fastening sleeve 40 and socket 30 be formed as a unitary structure comprising two similar halves that are mechanically interconnected. As with the ball structure, this type of configuration is particularly adapted for formation by traditional molding processes, especially as carried out with polymeric or resinous plastic materials. If this type of formation and material are used, the socket structure preferably is peripherally defined in a fashion substantially as illustrated, though undoubtedly it could be of solid nature so long as it has the specified configuration and structure.

The configurational relationship of fastening sleeve 40 and socket 30 may vary and remain within the scope of our invention. The preferred relationship is that illustrated wherein a plane through the rim of socket 30 would define a smaller included angle of approximately sixty degrees with the axis of channel 41, as this configuration tends to provide a maximized range of motion for second arm 13 while yet maintaining sizes of the various elements within reasonable limits. It is possible, however, that this angular relationship may extend from perpendicularity, with an included angle of ninety degrees, to one with an angle of thirty degrees or possibly even less, depending upon the particular limits of motion desired for the second arm. With an acute angulated relationship between the socket and fastening sleeve, I prefer to provide at least one fillet 45 between the elements for additional strength and rigidity. If such fillets be provided, they preferably define holes 46 through which screw connector 47 may be inserted to further aid in maintaining the two halves of the structure in interconnection.

If the socket and interconnected fastening sleeve are formed with two portions, it is preferable that those portions be mirror images of each other. To accomplish this, the seam between elements will extend in a plane that passes through the axis of the fastening sleeve and the center of hemispherical chamber 32 and defines the smallest included angle between the two elements, as illustrated in the drawings. The orientation of fastening pillars 42 preferably is perpendicular to such plane, and fillet structure 45 is bisected by that plane.

The material from which socket 30 is formed must have some deformable resilience to allow fastening of ball 29 within chambers 32 defined by the socket. The material must also have appropriate rigidity, strength and durability to otherwise fulfill the physical requirements imposed upon it. Material that has been found preferable for this purpose is one of the harder, more dense resinous or polymeric plastics that may be formed by some type of molding process. Preferably both the first arm structure, ball structure, socket structure and fastening sleeve are formed of such material.

Second arm 13 provides rigid linear inner tubular beam element 48 defining internal channel 49 to slidably receive rigid lineally outer tubular beam element 50. The external configuration of inner element 48 is such as to fit within channel 41 defined by tubular fastening sleeve 40 of the articulating linkage. The inner portion of tubular element 48 defines two spacedly related sets of paired diametrically opposed fastening holes 51 to receive fastening pillars 42 of the tubular fastening sleeve 40 in a fastening relationship. The outer end portion of outer tubular element 51 frictionally carries handle 52 for positional maintenance so that the handle may aid manual manipulation of that portion of the outer tubular element.

Figure 9:
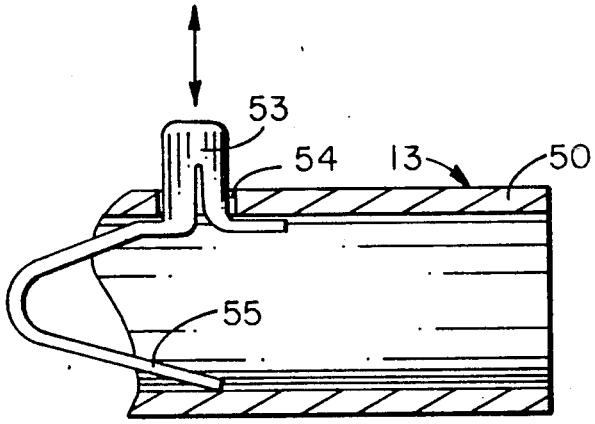
FIG. 9 is an enlarged partial sectional view showing the fastening button of the structure of FIG. 8. taken substantially within the dashed circle designated as 9 on that Figure.

Connecting mechanism carried at the intersection of the inner and outer tubular elements allows the releasable positioning of these elements relative to each other. The particular fastening mechanism illustrated provides outwardly biased fastening button 53 carried by the diametrically smaller outer tubular element to extend through hole 53 defined in that element spacedly inwardly from its inner end portion. As seen especially in the cross-sectional view of FIG. 9, the button 53 is biased to an outwardly extending position by leaf spring 55, but movable by manual pressure against its bias to a position within hole 54. The outer end of tubular element 48 defines hole 56 to receive button 53 in fastening engagement when in its normally outwardly biased position. Hole 56 is defined spacedly inwardly of the end portion of the inner tubular element so that when it engages fastening button 53, there will be sufficient end portions of the two tubular elements in adjacent engagement to provide a reasonably strong, durable interconnection. This known type of fastening structure allows the two arms to be interconnected substantially in their fullest extended position relative to each other.

Figure 8:
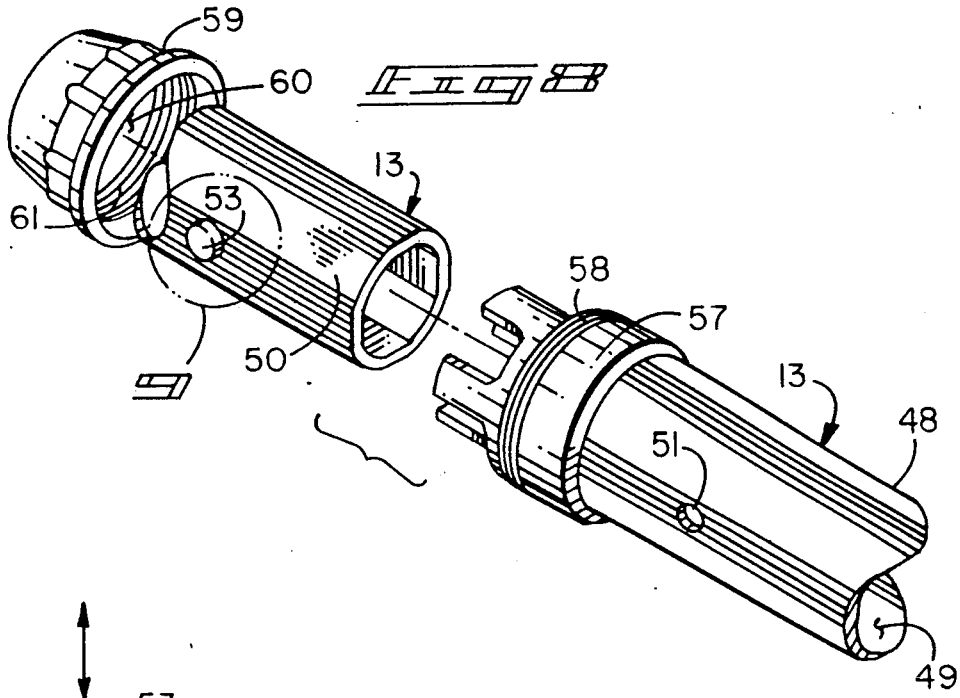
FIG. 8 is an enlarged isometric view of the structure that adjustably interconnects the the arms of our ancillary tiller.

I provide a second independent adjustable interconnection system for the arms 48, 50 in the form of a frictional conical connector, illustrated especially in FIG. 8. This type of connector provides annular male fastening sleeve 57 carried about the outer end portion of inner tubular element 48 and defining radially inwardly tapering conic threads 58 for interconnection with a female fastening portion. The female fastening portion provides annular body 59 defining internal channel 60 with conical thread 61 on its inner surface configured to threadedly engage threads 58 of the male member 57. The body 59 is carried axially inwardly of fastening button 53 so that that button, when in its normal biased outwardly extending position, tends to maintain the body 59 on the inner tubular element.

To use this conical interconnecting structure, the two tubular elements may be positioned relative to each other in a desired lineal array and when the particular positioning has been obtained by appropriate manipulation, the female fastening element is threadedly engaged upon the male element and tightened. As this occurs, the male element is deformed radially to frictionally engage the outer tubular element and thus positionally maintain it. This modified Jacobs type clamping structure is well known in the mechanical arts relating to tubular interconnections, constitutes no part of our invention as such, and therefore is not defined or illustrated in substantial detail.

Preferably, the tubular elements of the second arm are formed of metallic material, especially such as aluminum. For convenience, the channel defined in the diametrically larger lineally inner element is preferably somewhat polygonal in shape and the outer surface of the diametrically smaller lineally outer element is similarly shaped to prevent turning of the two elements relative to each other when using the rotatable connecting device. Those rotatable connecting devices, or at least the male portion of the device, must be formed of some material that is at least somewhat resiliently deformable to allow it to accomplish its purposes, and this material commonly is one of the polymeric or resinous plastics, though other materials having appropriate resilience and strength, such as aluminum, might be used for the purpose.

Having thusly described our invention, its operation may be understood.

An ancillary tiller arm is formed and assembled accordingly to the foregoing specification. The two halves of casement 14 of the motor mounting structure are taken apart and the structure positioned for mounting upon outboard motor 62 with which it is to be used. The mounting structure is then reassembled to fasten it upon the particular outboard motor and the extension arms are re-established on the mounting structure.

In the instance illustrated, the mounting structure is fastened about the upper medial portion of the depending propeller shaft of an outboard motor, though it may equally well be fastened on other motor portions, and especially a control handle of either the rod or stirrup-type. The type of mounting structure illustrated was adapted for mounting on the vertical shaft of a motor, though this particular structure is not essential to our invention and the same general type of mounting structure may be readily adapted to mount on other motor portions by appropriate changes in size and configuration that are well within the skills of an ordinary mechanic. The only requirements for this mounting structure are that it releasably interconnect to some portion of the outboard motor to be serviced so that it may pivot that motor upon the motor mounting structure to cause steerage of a powered boat, and that it provide appropriate means, such as mounting stub 21, to allow interconnection of the first arm 11 of our extension thereto.

Once the extension is so mounted, it is ready for positional adjustment for use.

The angular relationship between first arm 11 and second arm 13 is selectively determinable within limits by appropriate manipulation of articulating linkage 12. To adjust this angular relationship, fastening screw 37 of the clamping element is loosened and second arm 13 manually moved to the desired angular position. While the second arm is manually maintained in the desired position, fastening screw 37 is retightened to cause band 36 of the fastening device to tighten and slightly constrict socket 30 to cause the socket to frictionally engage ball 29 and positionally maintain that ball relative to socket 30. The range of motion of the second arm relative to the first arm is essentially limited by a conic surface having its apex at the center of the sphere defining ball 29 and extending with a central spherical angle of approximately one hundred sixty degrees.

The length of second arm 13 may then be adjusted by releasing fastenable engagement of the two second arm portions relative to each other and moving them to the position wherein they define the desired length. Once attained, positioning is manually maintained and either the fastening button structure interconnected, if appropriate, or the chuck type fastener operatively engaged to releasably maintain that position. It is to be noted that if the pin fastener is used, the chuck type fastener may also be simultaneously engaged to provide a doubly fastened structure. Though only one pin hole is illustrated in the diametrically larger inner tubular element, a plurality of such holes may be provided in spaced lineal array to allow button fastening at various positions, though this is not necessary in conjunction with the screw-type fastener which allows continuously variable positioning of the two arm members relative to each other.

The foregoing description of our invention is necessarily of a detailed nature so that a specific embodiment of it may be set forth as required, but it is to be understood that various modifications of detail, rearrangement and multiplication of parts might be resorted to without departing from its spirit, essence or scope.

Having thusly described our invention, what we desire to protect by Letters Patent, and

What we claim is:

1. An ancillary tiller for use with outboard motors for small boats that provide means for steerage by pivoting a vertical shaft relative to a boat, comprising, in combination:

motor mounting structure providing means for releasable mounting on the vertical shaft of an outboard motor, said motor mounting structure having a stub mounting shaft extending therefrom with means for releasably interconnecting a first arm thereto;

a first arm having a first inner end releasably interconnected to the stub mounting shaft of the motor mounting structure and extending a spaced distance therefrom;

articulating linkage including a spherical ball carried by the second outer end of the first arm and a socket movably carried by said ball, said socket defining a spherically shaped chamber comprising more than a diametrical half of a sphere substantially the same size as the ball to allow sliding motion of the ball in the chamber, and said socket further including band type adjustable fastening means structurally carried by and extending about the equatorial portion of the socket to resiliently deform the equatorial portion of the socket to cause frictional fastening of the ball therein, and a structurally interconnected fastening sleeve extending from the outer surface thereof; and a second arm releasably interconnected with the fastening sleeve of the socket and extending a spaced distance therefrom.

2. The invention of claim 1 wherein:

the ball of the articulating linkage defines two parallel diametrically opposed axle slots, each slot having innermost medial portions to pivotally receive the ends of an axle, and the socket element defines two diametrically aligned axles extending into chamber defined by the socket a spaced distance from the center thereof, said axles being configured to be received within the axle slots defined in the ball for pivotal support of the ball.

3. The invention of claim 1 further characterized by the second arm being of compound nature, comprising a diametrically larger, lineally inner cylinder defining an internal channel slidably carrying a diametrically smaller, lineally outer portion for slidable motion relative to the inner portion, and fastening means communicating between the lineally inner and outer portions of the second arm to reasonably position the two arm portions relative to each other.

* * * * *

UNITED STATES PATENT AND TRADEMARK OFFICE

CERTIFICATE OF CORRECTION

PATENT NO. : 5,046,974

DATED : September 10, 1991

INVENTOR(S) : WILLIAM J. GRIFFIN, JR. and WILLIAM J. GRIFFIN III

It is certified that error appears in the above—identified patent and that said Letters Patent is hereby corrected as shown below:

On the Title page

In Section 54 Please delete "FILLER"

and insert -TILLER-.

Signed and Sealed this

Twenty-second Day of December, 1992

*Attest:*

DOUGLAS B. COMER

*Attesting Officer*

*Acting Commissioner of Patents and Trademarks*